US010151135B2

(12) United States Patent
Shen

(10) Patent No.: US 10,151,135 B2
(45) Date of Patent: Dec. 11, 2018

(54) DOOR WITH A DOOR ACCESS SYSTEM

(71) Applicant: I-Ting Shen, Tainan (TW)

(72) Inventor: I-Ting Shen, Tainan (TW)

( * ) Notice: Subject to any disclaimer, the term of this patent is extended or adjusted under 35 U.S.C. 154(b) by 64 days.

(21) Appl. No.: 15/441,314

(22) Filed: Feb. 24, 2017

(65) Prior Publication Data

US 2018/0209203 A1 Jul. 26, 2018

(30) Foreign Application Priority Data

Jan. 26, 2017 (TW) ..... 106103130 A

(51) Int. Cl.

| | |
|---|---|
| ***E05F 15/73*** | (2015.01) |
| ***E05B 65/00*** | (2006.01) |
| ***E05F 15/77*** | (2015.01) |

(52) U.S. Cl.

CPC ..... *E05F 15/73* (2015.01); *E05B 65/0035* (2013.01); *E05F 15/77* (2015.01); *E05F 2015/767* (2015.01); *E05Y 2400/45* (2013.01); *E05Y 2400/852* (2013.01); *E05Y 2400/858* (2013.01); *E05Y 2400/86* (2013.01); *E05Y 2800/426* (2013.01)

(58) Field of Classification Search

CPC . E05F 15/73; E05F 15/60; E05F 15/78; E05F 2015/767; E05B 65/0035; E06B 7/30

USPC ..... 49/25–31

See application file for complete search history.

(56) References Cited

U.S. PATENT DOCUMENTS

| | | | | |
|---|---|---|---|---|
| 3,203,052 | A * | 8/1965 | Curtis, Jr. | E06B 7/30 359/839 |
| 3,310,794 | A * | 3/1967 | Lusebrink | E06B 7/28 340/594 |
| 5,016,035 | A * | 5/1991 | Myles, Jr. | G03B 17/40 396/2 |
| 5,739,523 | A * | 4/1998 | Tsutsumi | E05F 15/73 250/221 |
| 6,059,420 | A * | 5/2000 | Rogers | A47F 3/0434 362/223 |
| 6,182,402 | B1 * | 2/2001 | Aalst | E06B 7/30 49/15 |
| 6,570,498 | B1 * | 5/2003 | Frost | G07C 9/00079 340/5.2 |
| 8,131,024 | B2 * | 3/2012 | Haynes | G03B 15/10 348/222.1 |
| 2005/0238213 | A1 * | 10/2005 | Randazza | E05G 5/003 382/124 |

(Continued)

*Primary Examiner* — Justin B Rephann

(74) *Attorney, Agent, or Firm* — Alan D. Kamrath; Kamrath IP Lawfirm, P.A.

(57) ABSTRACT

A door (20) with a door access system is movable between an open position and a closed position and includes a first side (20A) and a second side (20B). The door (20) further includes a chamber (48) therein. The door (20) further includes a translucent reflective layer (36) mounted to the first side (20A) of the door (20). An intensity of a reflected portion of light reflected by the translucent reflective layer (36) is greater than an intensity of a transmitted portion of the light transmitted through the second side (20B) to the first side (20A) of the door (20). A door access system (10) is coupled to the door (20) and includes a door access control device (50) mounted in the chamber (48) of the door (20). The door access control device (50) is configured to control opening of the door (20).

3 Claims, 9 Drawing Sheets

(56) References Cited

U.S. PATENT DOCUMENTS

| | | | | |
|---|---|---|---|---|
| 2005/0247823 | A1* | 11/2005 | Wood | B29C 45/14 244/129.5 |
| 2008/0163462 | A1* | 7/2008 | King | E05B 17/0033 16/412 |
| 2015/0320209 | A1* | 11/2015 | Hasselback | H04N 5/2251 348/151 |
| 2016/0369998 | A1* | 12/2016 | Ellis | F21V 33/006 |
| 2017/0303684 | A1* | 10/2017 | Chen | A47B 67/005 |
| 2018/0038634 | A1* | 2/2018 | Kim | F25D 29/005 |

* cited by examiner

DOOR WITH A DOOR ACCESS SYSTEM

BACKGROUND OF THE INVENTION

The present invention relates to a door with a door access system and, more particularly, to a door with a door access system using an electronic identification to identify the identity of a passerby before opening a door.

Doors, when locked with locks, cannot be opened unless an unlocking operation is provided. Furthermore, doors are often opaque for privacy purposes. When these doors are mounted in a space not permitting installation of windows, a person in the space would feel oppressed.

BRIEF SUMMARY OF THE INVENTION

A door with a door access system according to the present invention is movable between an open position and a closed position and includes a first side and a second side. The door further includes a chamber therein. The door further includes a translucent reflective layer mounted to the first side of the door. An intensity of a reflected portion of light reflected by the translucent reflective layer is greater than an intensity of a transmitted portion of the light transmitted through the second side to the first side of the door. A door access system is adapted to be coupled to the door and includes a door access control device mounted in the chamber of the door. The door access control device is configured to control opening of the door.

In an example, the door further includes a frame having a first engaging portion and a second engaging portion. The chamber is located between the first and second engaging portions. A double-sided mirror is mounted to the first engaging portion of the frame The double-sided mirror includes an inner face abutting a side of the first engaging portion and an outer face opposite to the inner face. The translucent reflective layer is disposed on the outer face of the double-sided mirror. A light-transmittable mirror is mounted to the second engaging portion of the frame.

In an example, the light-transmittable mirror includes alight blocking layer disposed on a portion of an outer side of the light-transmittable mirror. The light blocking layer is configured to cover the door access control device. The light blocking layer has an area slightly larger than an area of the door access control device. The light blocking layer is configured to block light from passing through the door access control device.

In an example, the door further includes a door locking device in electrical connection with the door access control device. The door access control device includes a control module in electrical connection with the door locking device and configured to set the door locking device to a locking state or an unlocking state. The door access control device further includes a transparent screen in electrical connection with the control module. The transparent screen abuts the inner surface of the double-sided mirror.

When the door is in the closed position and the door locking device is set to the locking state, the door is not movable from the closed position to the open position. When the door is in the closed position and the door locking device is set to the unlocking state, the door is movable from the closed position to the open position.

The transparent screen displays a first message when the door access control device sets the door locking device to the unlocking state. The transparent screen displays a second message when the door access control device sets to the door locking device to the locking state. When the presence of a passerby at an outside of the door is not detected, the control module controls the transparent screen to hibernate.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
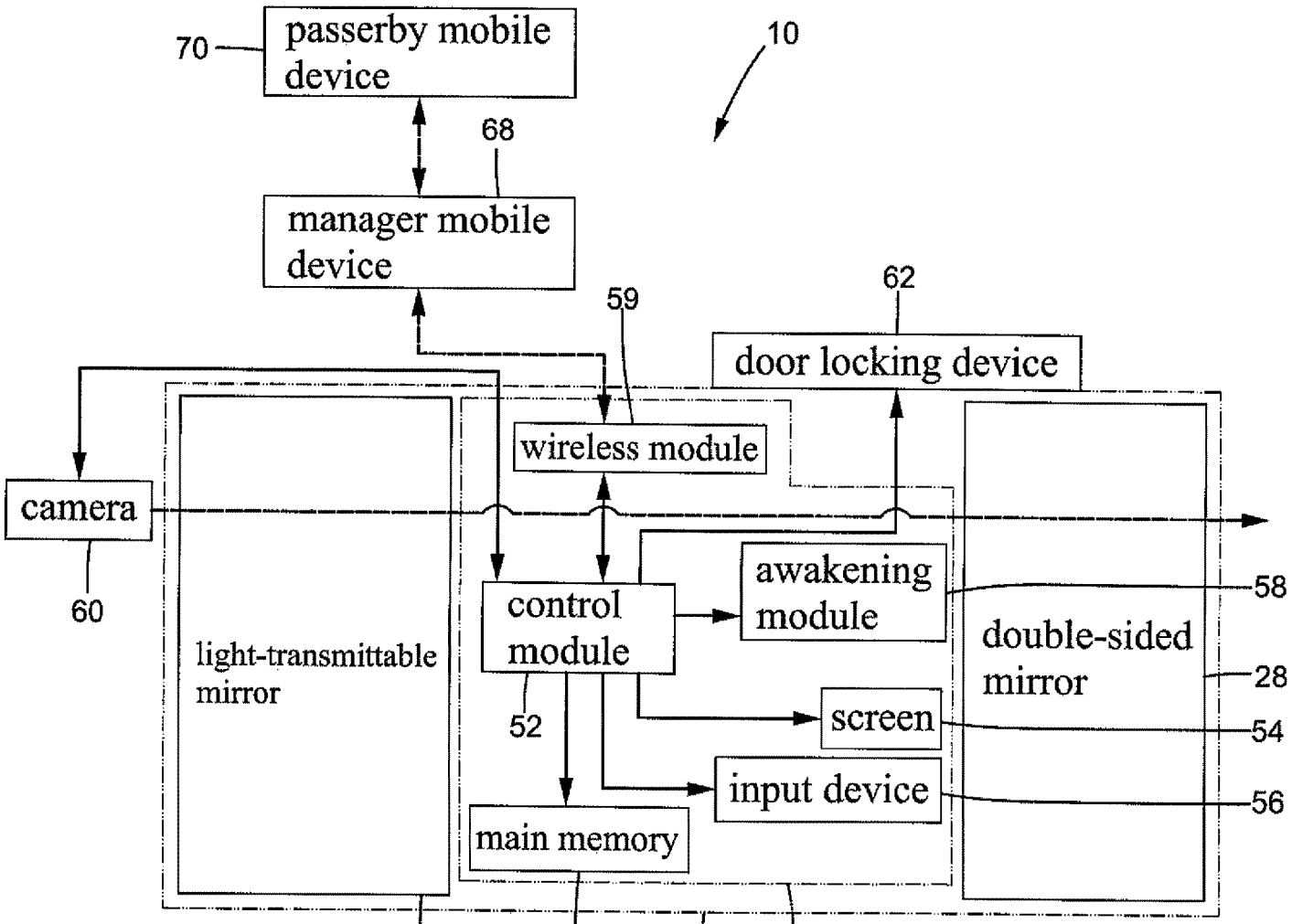
FIG. 1 is a diagrammatic block diagram of a door access system of a first embodiment used with a door according to the present invention.
Figure 2:
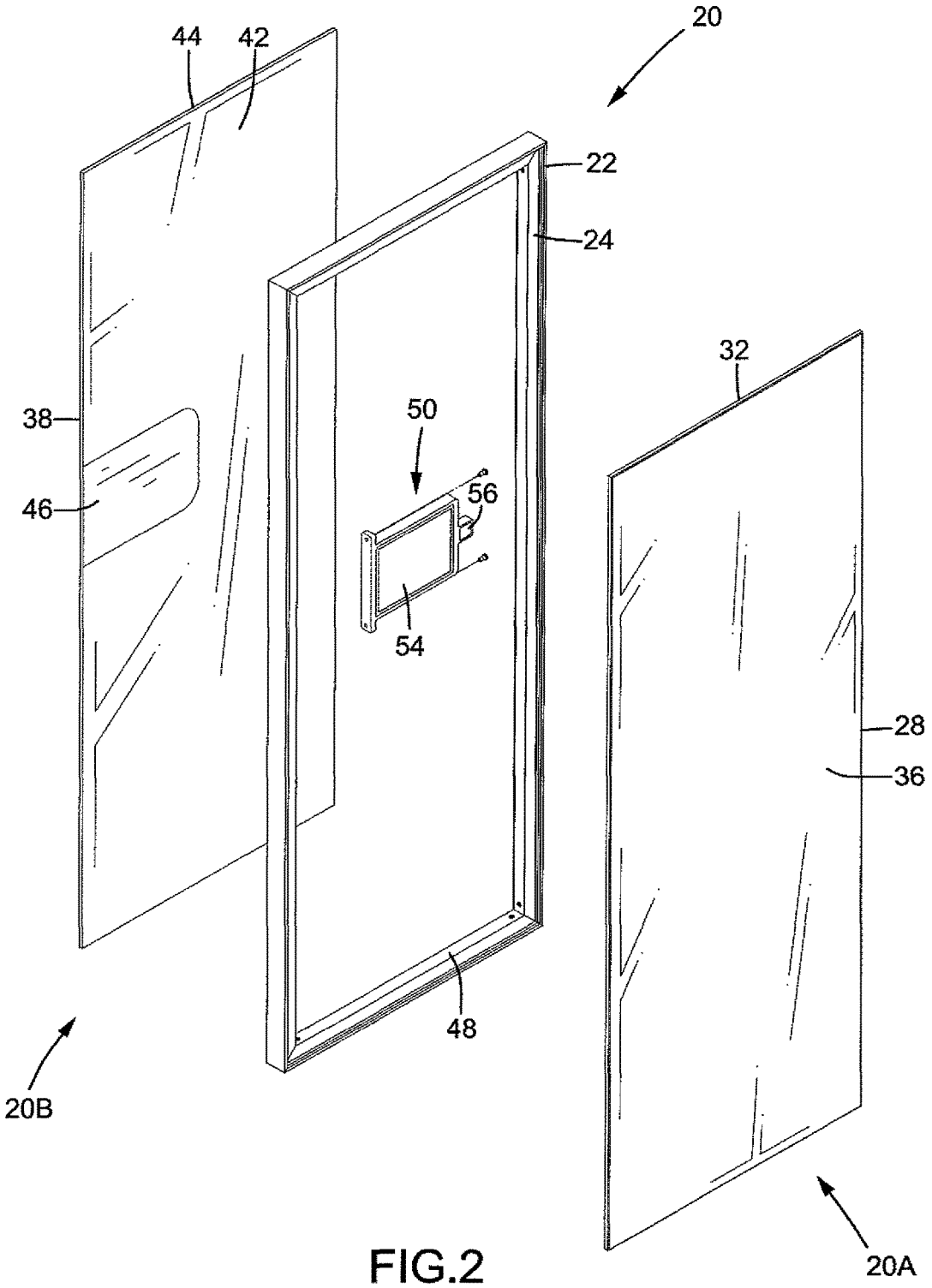
FIG. 2 is an explode& perspective view of the door using the door access system of FIG. 1.
Figure 3:
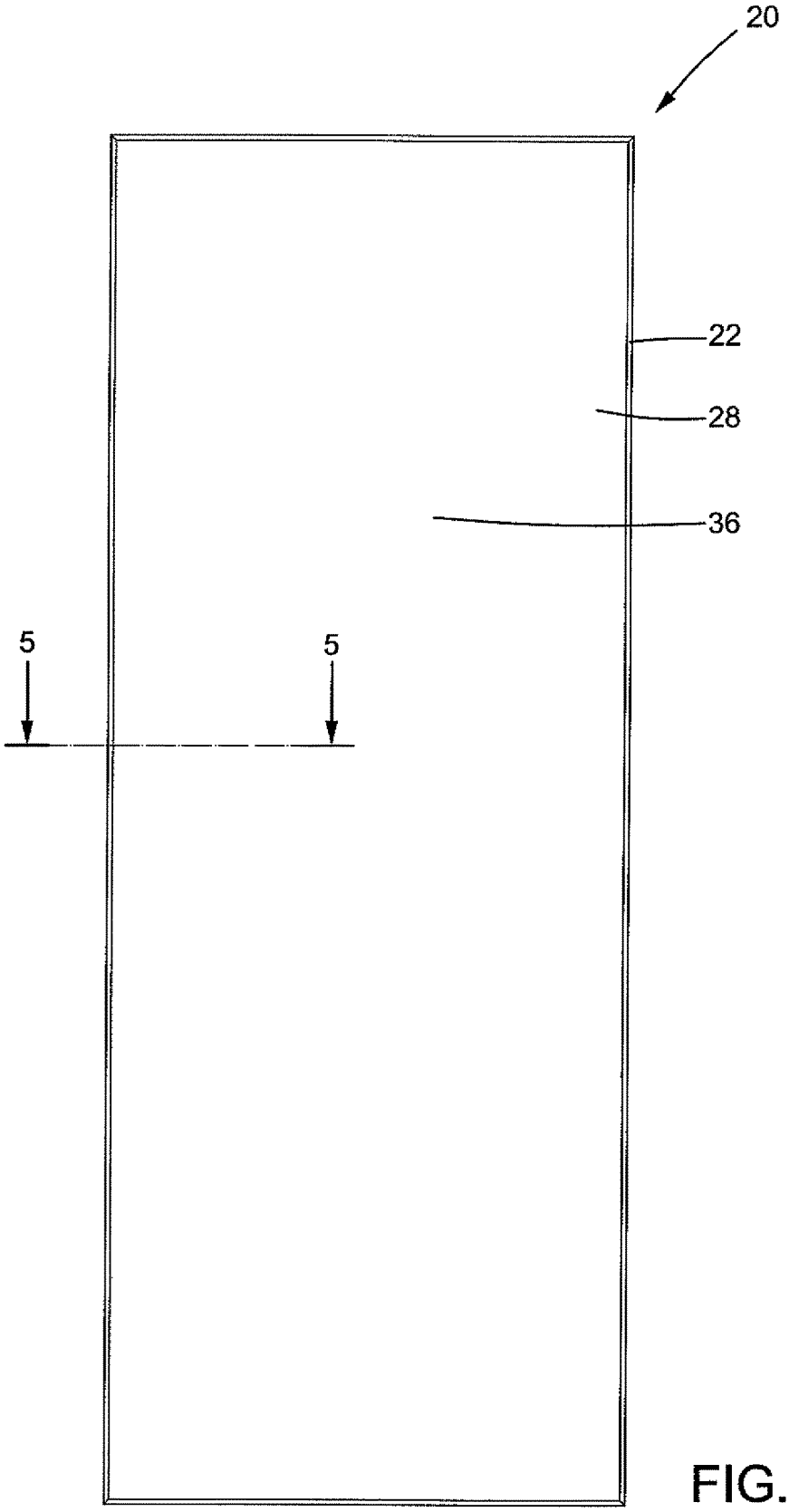
FIG. 3 is a front view of the door of FIG. 2 after assembly.
Figure 4:
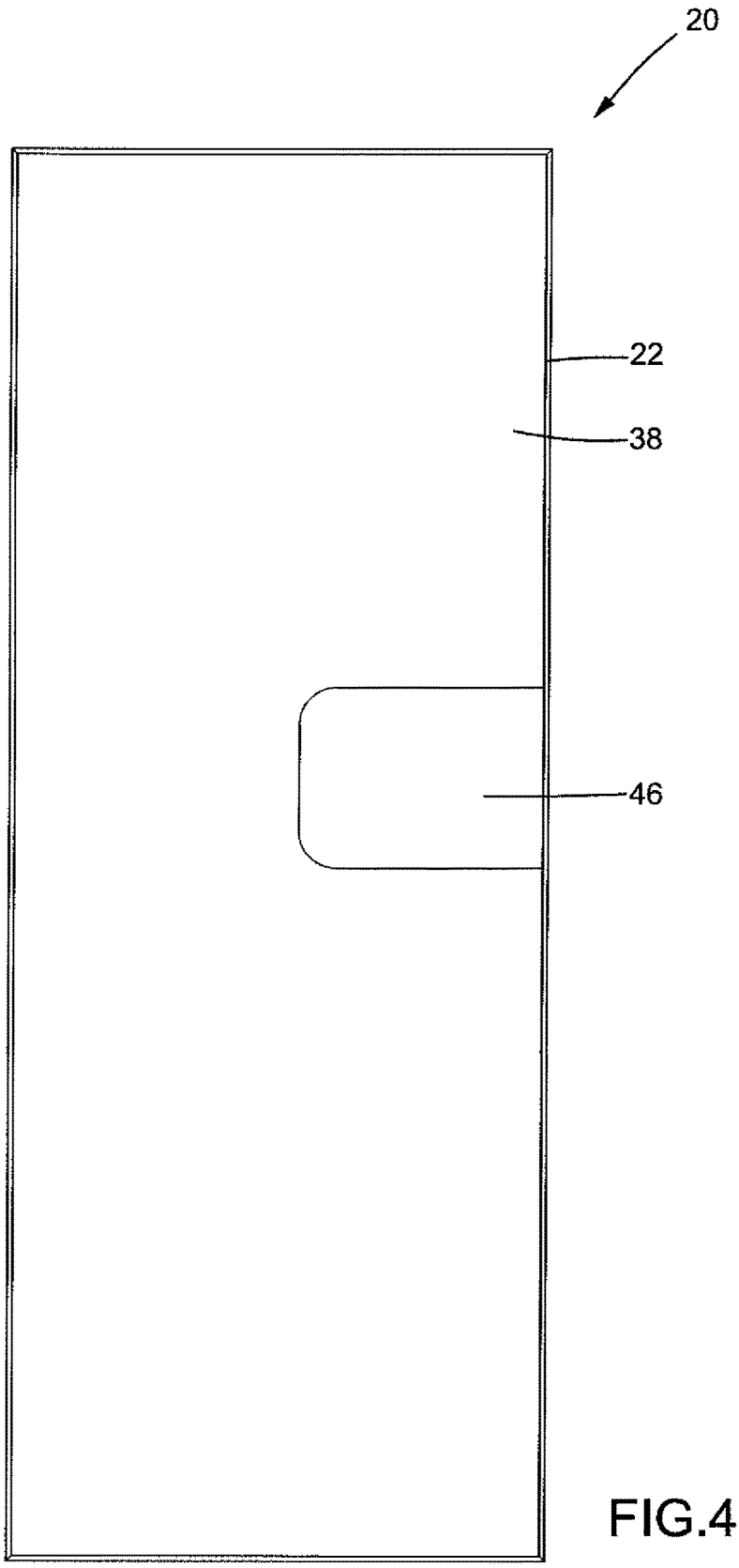
FIG. 4 is a rear view of the door of FIG. 2 after assembly.
Figure 5:
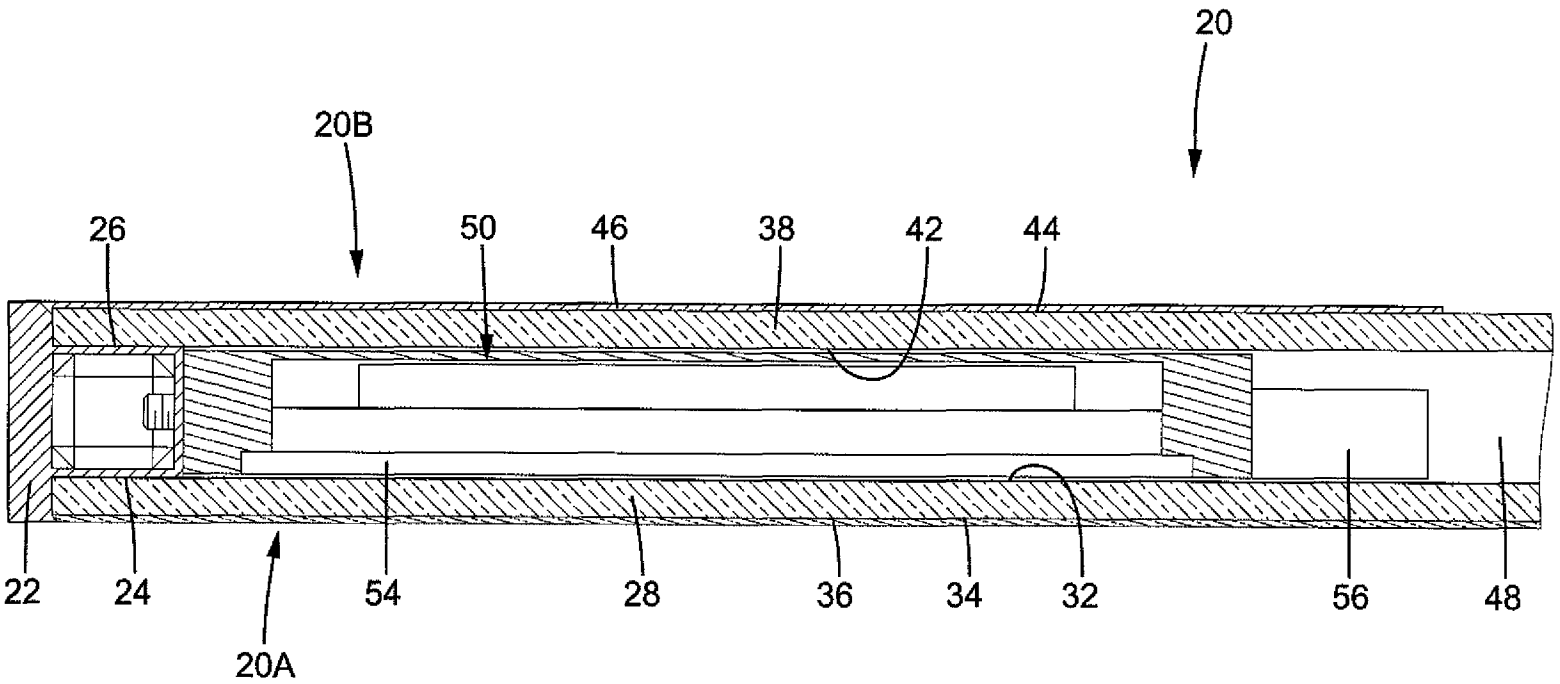
FIG. 5 is a cross sectional view taken along section line 5-5 of FIG. 3.
Figure 6:
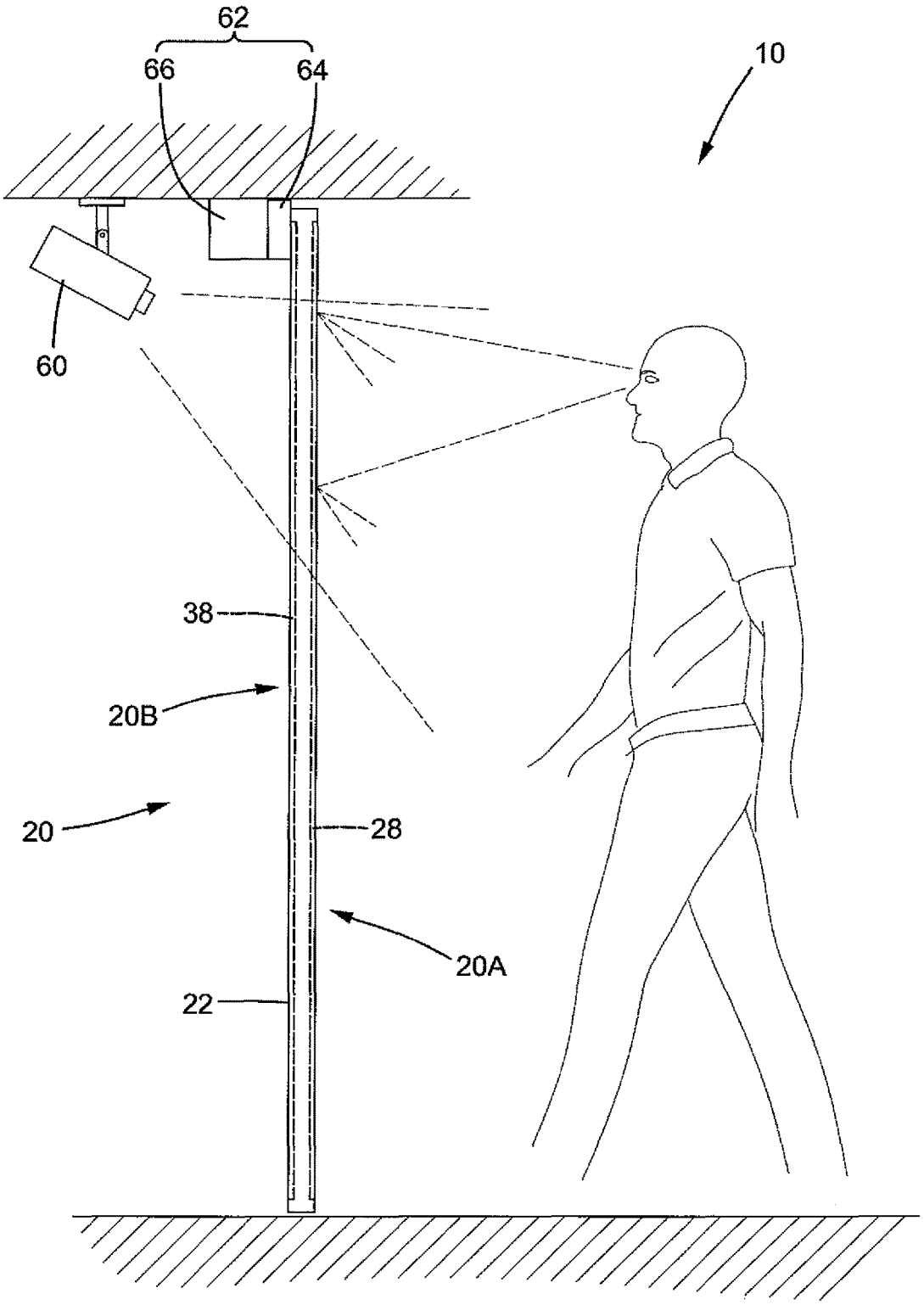
FIG. 6 is a diagrammatic view illustrating use of the door with the door access system of FIG. 1.
Figure 7:
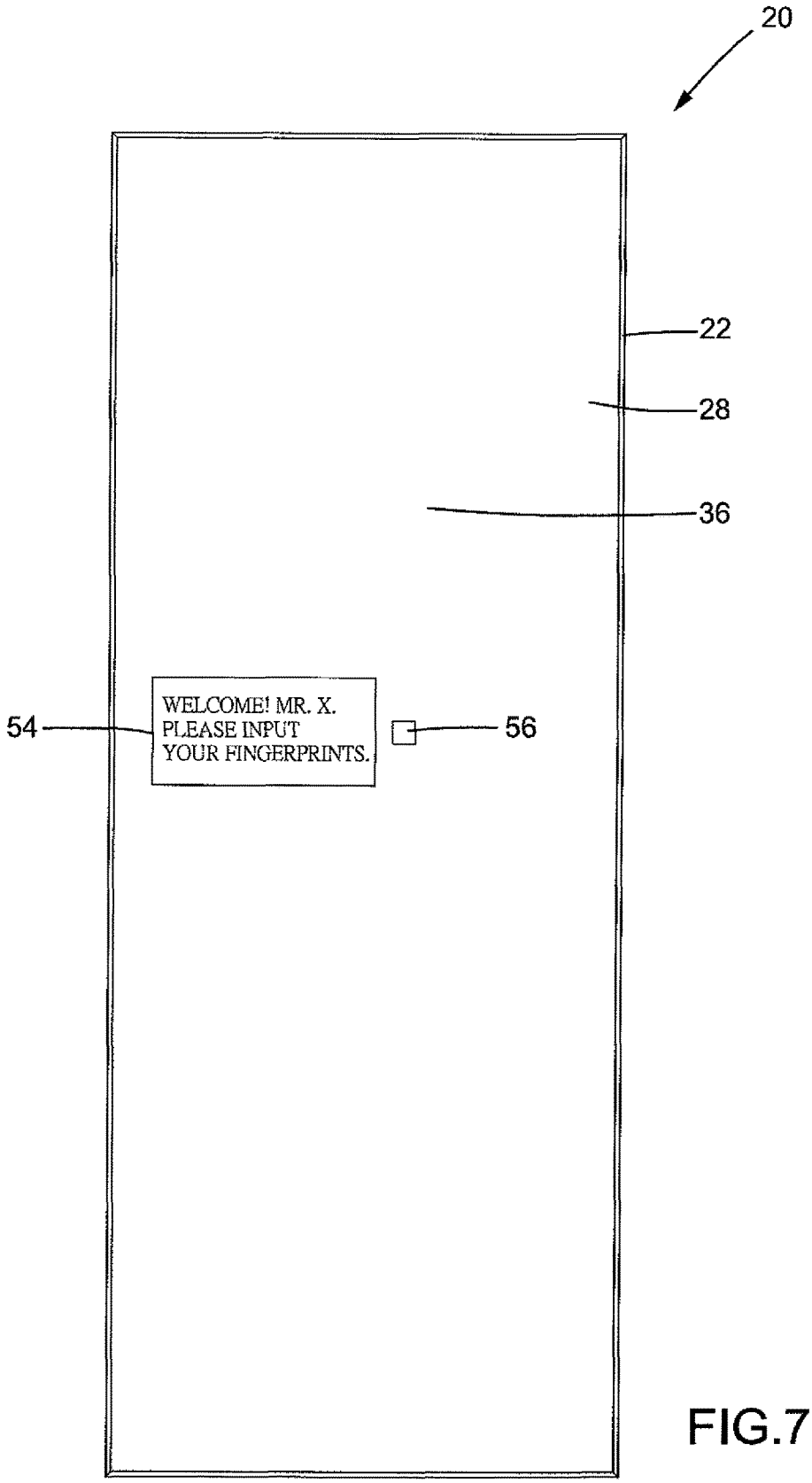
FIG. 7 is a front view of the door of FIG. 2, illustrating operation of a screen of the door access system of FIG. 1.

All figures are drawn for ease of explanation of the basic teachings only, the extensions of the figures with respect to number position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the, following teachings have been read and understood.

Where used in the various figures of the drawings, the same numerals designate the same or similar parts. Furthermore, when the terms "first" "second", "inner", "outer", "side" "face", "portion", "inside", "outside", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

With reference to FIGS. 1-7, a door 20 with a door access system 10 of a first embodiment according to the present invention is transmittable to light and has a frame 22 Door 20 includes a first side 20A on a side of frame 22 and a second side 20B on the other side of frame 22 Frame 22 includes a first engaging portion 24 and a second engaging portion 26. First engaging portion 24 is on first side 20A of door 20, and second engaging portion 26 is on second side 20B of door 20. Frame 22 further includes a chamber 48 located between first and second engaging portions 24 and 26. In this embodiment, each of first and second engaging, portions 24 has a recess intercommunicated with chamber 48.

Door access system 10 includes a door access control device 50 mounted in chamber 48. Door access control device 50 includes a control module 52, an awakening device 58, a screen 54, an input device 56, and a main memory 61 (FIG. 1). Awakening device 58, screen 54, input device 56, and main memory 61 arc in electrical connection with the control module 52. Door access control device 50 is securely mounted to a side of frame 22 (the right side of frame 22, see FIGS. 3 and 5).

Main memory 61 is used to store authenticated unlocking information registered in advance. Awakening device 58 is configured to detect the presence of the passerby at the outside of the door 20. Input device 56 is configured to input unlocking information by the passerby. Input device 56 can be a fingerprint pickup device, an iris pickup device, a keyboard for entering digital numbers and/or letters, a touch screen (such as screen 54), or a microphone. A wireless module 59 provides connection between a manager mobile device 68 held by a manager and door access control device 50. Manager mobile device 68 can use wireless module 59 to register authenticated unlocking information into main memory 61. Unlocking information can be the image of the passerby (such as the facial pattern), or the image of the passerby plus the fingerprints, iris, or vocal patterns of the passerby, a pin code consisting of digital numbers and/or letters, or a specific figure (inputted through the touch screen). Furthermore, screen 54 is used to display the state of door access system 10. For example, when door locking device 62 is set to the unlocking state, screen 54 displays the identity of the passerby, a welcome message, and/or a message requesting the passerby to input additional unlocking information including one of the fingerprints, iris, or vocal patterns of the passerby, a pin code consisting of digital numbers and/or letters, or a specific figure (see FIG. 7). Screen 54 can also display an error message if the unlocking information inputted by the passerby is incorrect.

Door 20 further includes a double-sided mirror 28 received in first engaging portion 24 and located at first side 20A. Double-sided mirror 28 includes an inner face 32 abutting a side of first engaging portion 24 and an outer face 34 opposite to inner face 32. Double-sided mirror 28 further includes a translucent reflective layer 36 mounted to outer face 34. Translucent reflective layer 36 can be a metal film (such as a silver film or an aluminum film) coated on outer face 34. Translucent reflective layer 36 reflects a portion of light and permits transmission of another portion of the light. Namely, translucent reflective layer 36 is used to increase the reflectivity on outer face 34 of double-sided mirror 28, but the un-reflected portion of the light can pass through double-sided mirror 28. The intensity of a reflected portion of light reflected by translucent reflective layer 36 is greater than the intensity of a transmitted portion of the light transmitted through second side 20B to first side 20A of door 20.

Screen 54 abuts inner face 32 of double-sided mirror 28. When screen 54 operates, the light generated by screen 54 can pass through double-sided mirror 28, such that the passerby at the outside of door 20 and facing first side 20A can see the picture of screen 54. In a case that input device 56 is a fingerprint pickup device, an iris pickup device, or a touch screen, input device 56 can abut inner face 32 of double-sided mirror 28 while permitting operation. In another case that input device 56 is a keyboard for entering digital numbers and/or letters or a microphone, a window must be provided in a location to permit access to input device 56.

Door 20 further includes a light-transmittable mirror 38 received in second engaging portion 26 and located at second side 20B. Light-transmittable mirror 38 includes an inner side 42 abutting a side of second engaging portion 26 and an outer side 44 opposite to inner side 42. Light-transmittable mirror 38 further includes a light blocking layer 46 (FIG. 4) disposed on a portion of an outer side 44 of light-transmittable mirror 38 and covering door access control device 50. Light blocking layer 46 has an area slightly larger than an area of door access control device 50 and is configured to block light from passing through door access control device 50. Since door access control device 50 is covered by light blocking layer 46, door access control device 50 cannot be seen when viewing light-transmittable mirror 38 from second side 20B of door 20.

Door 20 can be mounted in a. passageway between two spaces (referred to as an inside and an outside for ease of explanation). When door 20 is in a closed position, double-sided mirror 28 faces the outside, and light-transmittable mirror 38 faces the inside. Preferably, the intensity of the light at the inside of door 20 is weaker than the intensity of the light at the outside of door 20. Thus, the inside of door 20 cannot be seen from the outside of door 20.

A camera 60 is provided to be in electrical connection with the door access control device 50, such as in electrical connection with control module 52. Camera 60 can be mounted to a ceiling at the inside of door 20 facing the second side 20B of the door 20 in the closed position. Since a portion of light can pass from the outside of door 20 through first side 20A, double-sided mirror 28, and second side 20B to the inside of door 20, camera 60 can pick up the image at the outside of door, 20 and can send the image to door access control device 50.

In this embodiment, a door locking device 62 is mounted between camera 60 and door 20 in the closed position. Door locking device 62 in this embodiment is a magnetic lock and includes a first portion 64 made of a magnetically attractive material and secured to the inside of door 20 and a second portion 66 fixed to the ceiling. Second portion 66 is made of a material that generates a magnetic force when supplied with electricity Door access control device 50 is configured to set door locking device 62 to a locking state or an unlocking state. When door locking device 62 is set to the locking state, second portion 66 is supplied with electricity to generate a magnetic force attracting first portion 64. When door locking device 62 is set to the unlocking state, second portion 66 is not supplied with electricity and does not generate the magnetic force.

Door access system 10 successfully matches with manager mobile device 68 (such as a mobile phone of the manager) via door access control device 50, such that the unlocking information of authorized persons granted with door access authority is registered in main memory 61 of door access control device 50. A passerby can connect his or her passerby mobile device 70 with manager mobile device 68 and can send his or her image, his or her image plus his or her fingerprints, iris, or vocal patterns, a pin code consisting of digital numbers and/or letters, or a specific figure to manager mobile device 68 of the manager. If the manager approves the application of the passerby, the manager uses manager mobile device 68 to register the image of this passerby (such as the facial pattern), the image of this passerby plus the fingerprints, iris, or vocal patterns of this passerby, a pin code consisting of digital numbers and/or letters, or a specific figure into main memory 61 as authenticated unlocking information. This passerby becomes an authorized person granted with the door access authority. Thus, door access system 10 can operate normally when door access control device 50 has at least one piece of data of authenticated unlocking information.

Now that the basic construction of door 20 with door access system 10 has been explained, the operation and some of the advantages of door 20 with door access system 10 can be set forth and appreciated. In particular, for the sake of explanation, it will be assumed that door 20 is in the closed position and door locking device 62 is set to the locking state, such that first portion 64 of door locking device 62 is attracted by the magnetic force of second portion 66. Thus, door 20 is not movable from the closed position to the open position.

In a case that door access control device 50 only uses the image of an authorized person as the authenticated unlocking information, control module 52 controls camera 60 and screen 54 to hibernate when the presence of the passerby at the outside of door 20 is not detected. Door 20 provides a visual effect as a mirror when viewed from the outside of door 20 (see FIG. 3).

On the other hand, when awakening module 58 detects the presence of the passerby at the outside of door 20, awakening module 58 sends a signal to control module 52. Control module 52 awakens screen 54 and camera 60. Camera 60 picks up the image of the passerby and sends the image of the passerby to control module 52. Control module 52 compares the image of the passerby with the authenticated unlocking information. If the image of the passerby matches a piece of data of the authenticated unlocking information, control module 52 controls screen 54 to display a first message (such as a message including unlocking and welcome information) and sets door locking device 62 to the unlocking state, such that the passerby can move door 20 from the closed position to the open position. On the other hand, if the image of the passerby does not match any piece of data of the authenticated unlocking information, control module 52 controls screen 54 to display a second message (such as an error message) and sets door locking device 62 to the unlocking state (or door locking device 62 remains in the unlocking state). Thus, the passerby cannot move door 20 from the closed position to the open position.

In another case that door access control device 50 uses the image and fingerprints of an authorized person as the authenticated unlocking information (and input device 56 is a fingerprint pickup device), control module 52 controls camera 60, screen 54, and input device 56 to hibernate when the presence of the passerby at the outside of door 20 is not detected.

On the other hand, when awakening module 58 detects the presence of the passerby at the outside of door 20, awakening module 58 sends a signal to control module 52. Control module 52 awakens screen 54, camera 60, and input device 56. Camera 60 picks up the image (such as the facial pattern) of the passerby, and sends the image of the passerby to control module 52. Screen 54 displays a message requesting the passerby to input his or her fingerprints. Control module 52 compares the image and the fingerprints of the passerby with the authenticated unlocking information.

If the image and the fingerprints of the passerby match a piece of data (including image and fingerprints) of the authenticated unlocking information, control module 52 controls screen 54 to display a first message (such as a message including unlocking and welcome information) and sets door locking device 62 to the unlocking state, such that the passerby can move door 20 from the closed position to the open position.

On the other hand, if the image and fingerprints of the passerby do not match any piece of data of the authenticated unlocking information (at least one of the image and the fingerprints of the passerby is incorrect), control module 52 controls screen 54 to display a second message (such as an error message) and sets door locking device 62 to the unlocking state (or door locking device 62 remains in the unlocking state). Thus, the passerby cannot move door 20 from the closed position to the open position.

Figure 8:
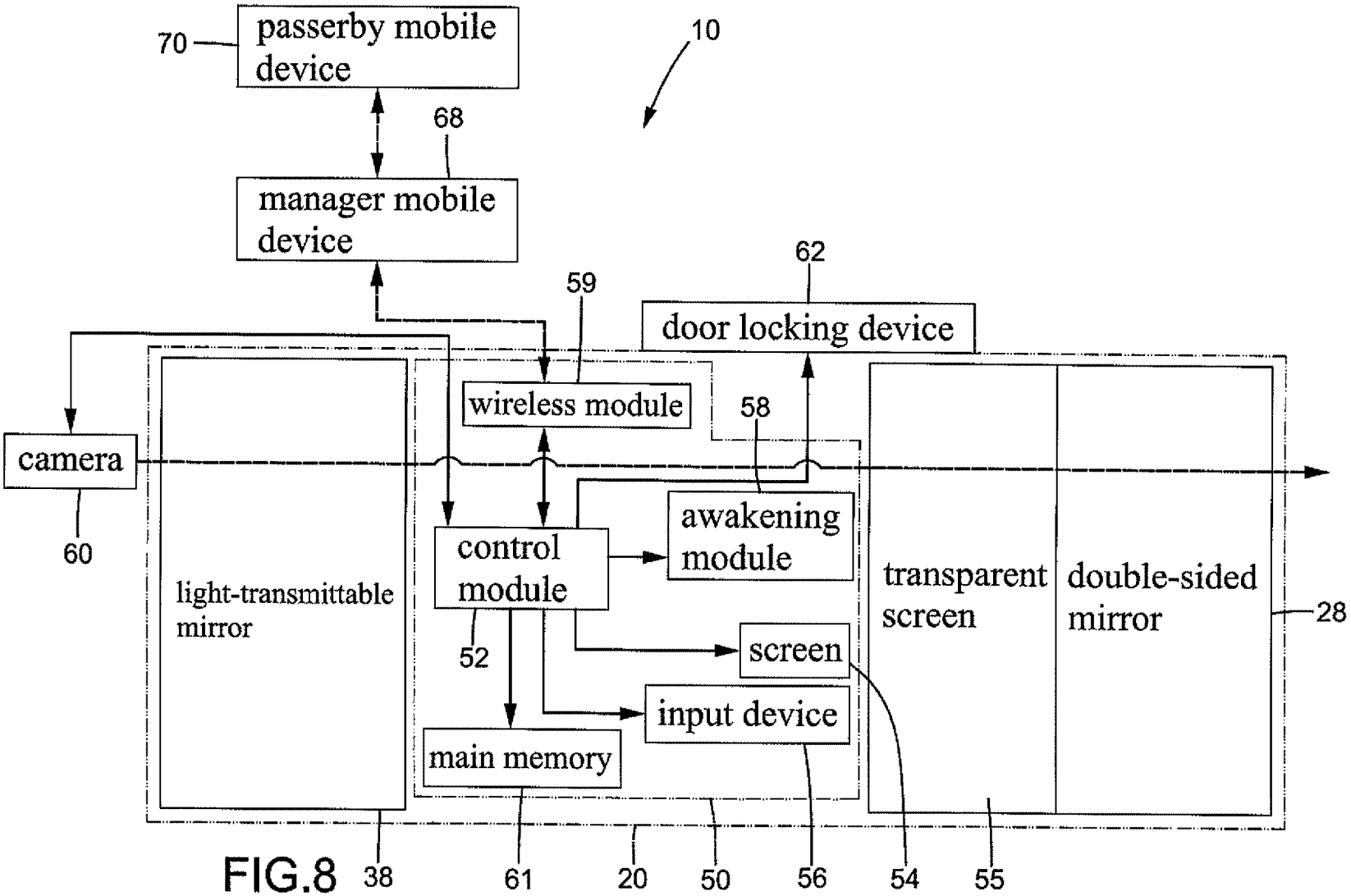
FIG. 8 is a diagrammatic block diagram of a door access system of a second embodiment
Figure 9:
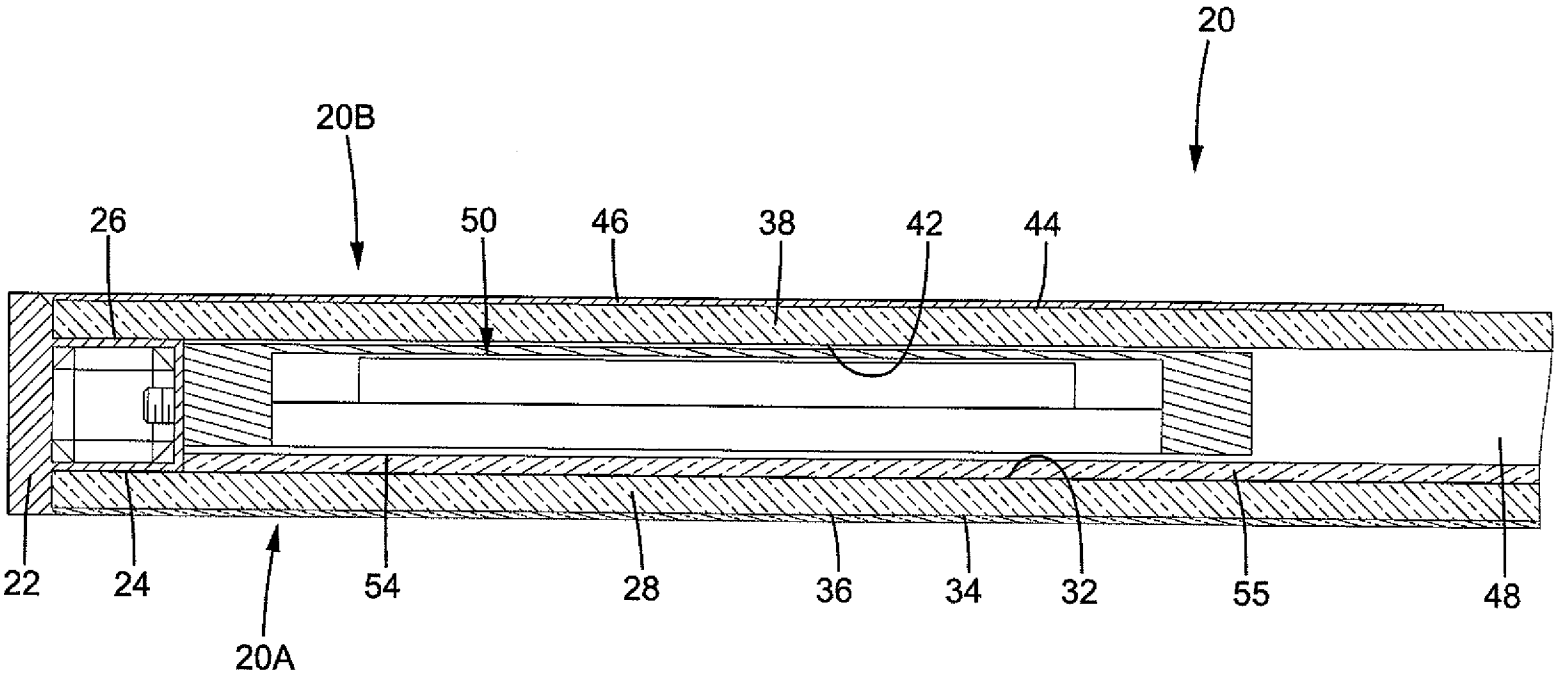
FIG. 9 is a cross sectional view of a door using the door access system of FIG. 8.

FIGS. 8 and 9 show a door 20 with a door access system 10 of a second embodiment. Specifically, screen 54 in the first embodiment only shows the picture in a portion of first side 20A of door 20. In the second embodiment, door access control device 50 includes a transparent screen 55 in electrical connection with control module 52. Transparent screen 55 abuts inner surface 32 of double-sided minor 28 and can extend through the span of the whole double-sided mirror 28. Transparent screen 55 can be a transparent touch screen permitting input of the unlocking information other than the image. Transparent screen 55 displays a first message when door access control device 50 sets door locking device 62 to the unlocking state. On the other hand, transparent screen 55 displays a second message when door access control device 50 sets to door locking device 62 to the locking state. When the presence of the passerby at the outside of the door 20 is not detected, the control module 52 controls the transparent screen 55 to hibernate.

In each embodiment, if door access control device 50 only uses the image of an authorized person as the authenticated unlocking information, camera 60 picks up the image of the passerby at the outside of door 20, and control module 52 controls door locking device 62 to the locking state or the unlocking state. Thus, operation of the passerby is not required for the door access control.

In each embodiment, if door access control device 50 uses the image and additional unlocking information (one of the fingerprints, iris, or vocal patterns, a pin code consisting of digital numbers and/or letters, or a specific figure) as the authenticated unlocking information, door access control device 50 sets door locking device 62 to the unlocking state only when both of the image and the additional unlocking information are correct which provides high security in use.

Furthermore, through use of double-sided mirror 28 and light-transmittable mirror 38, it is difficult to see the inside of door 20 from the outside of door 20, but a person at the inside of door 20 can see the outside of door 20, providing the function of a window while achieving the door access control function and keeping privacy.

The surfaces of door 20 are mirror surfaces without any protrusions, such that door 20 can match the indoor decoration. Furthermore, first side 20A of door 20 can be used as a mirror.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A door with a door access system, with the door movable between an open position and a closed position and comprising a first side and a second side, with the door further comprising a chamber therein, with the door further comprising a translucent reflective layer mounted to the first side of the door, with an intensity of a reflected portion of light reflected by the translucent reflective layer being greater than an intensity of a transmitted portion of the light transmitted through the second side to the first side of the door, with the door access system adapted to be coupled to the door and including a door access control device mounted in the chamber of the door, with the door access control device configured to control opening of the door, with the door further comprising:

a frame including a first engaging portion and a second engaging portion, with the chamber located between the first and second engaging portions;

a double-sided mirror mounted to the first engaging portion of the frame, with the double-sided mirror including an inner face abutting a side of the first engaging portion and an outer face opposite to the inner face, with the translucent reflective layer disposed on the outer face of the double-sided mirror; and a light-transmittable mirror mounted to the second engaging portion of the frame.

2. The door with the door access system as claimed in claim 1, with the light-transmittable mirror including a light blocking layer disposed on a portion of an outer side of the light-transmittable mirror, with the light blocking layer configured to cover the door access control device, with the light blocking layer having an area slightly larger than an area of the door access control device, and with the light blocking layer configured to block light from passing through the door access control device.

3. The door with the door access system as claimed in claim 1, further comprising a door locking device in electrical connection with the door access control device, with the door access control device including a control module in electrical connection with the door locking device and configured to set the door locking device to a locking state or an unlocking state, with the door access control device further including a transparent screen in electrical connection with the control module, with the transparent screen abutting the inner surface of the double-sided mirror, with the door in the closed position and with the door locking device set to the locking state, the door is not movable from the closed position to the open position, with the door in the closed position and with the door locking device set to the unlocking state, the door is movable from the closed position to the open position, wherein the transparent screen displays a first message when the door access control device sets the door locking device to the unlocking state, wherein the transparent screen displays a second message when the door access control device sets to the door locking device to the locking state, and wherein when the presence of a passerby at an outside of the door is not detected, the control module controls the transparent screen to hibernate.

* * * * *